US007396019B2

(12) United States Patent
Barranco et al.

(10) Patent No.: US 7,396,019 B2
(45) Date of Patent: Jul. 8, 2008

(54) VALVE GASKET

(75) Inventors: Sandrine Barranco, Saint Sébastien de Morsan (FR); Patrice Leone, Acquigny (FR)

(73) Assignee: Valois S.A.S, Le Neubourg (FR)

( * ) Notice: Subject to any disclaimer, the term of this patent is extended or adjusted under 35 U.S.C. 154(b) by 447 days.

(21) Appl. No.: 10/487,927

(22) PCT Filed: Aug. 29, 2002

(86) PCT No.: PCT/FR02/02957

§ 371 (c)(1),
(2), (4) Date: Sep. 20, 2004

(87) PCT Pub. No.: WO03/018432

PCT Pub. Date: Mar. 6, 2003

(65) Prior Publication Data

US 2005/0067796 A1 Mar. 31, 2005

(30) Foreign Application Priority Data

Aug. 29, 2001 (FR) ..... 01 11237

(51) Int. Cl.
*F16J 15/00* (2006.01)

(52) U.S. Cl. ..... 277/500

(58) Field of Classification Search ..... 222/402.1; 277/500

See application file for complete search history.

(56) References Cited

U.S. PATENT DOCUMENTS

| | | | | |
|---|---|---|---|---|
| 3,858,764 | A | 1/1975 | Watson | |
| 6,131,777 | A * | 10/2000 | Warby | 222/402.1 |
| 6,158,629 | A * | 12/2000 | Abplanalp et al. | 222/402.1 |

FOREIGN PATENT DOCUMENTS

| | | | |
|---|---|---|---|
| GB | 2 323 597 | A | 9/1998 |
| WO | WO 00 37582 | A | 6/2000 |

* cited by examiner

*Primary Examiner*—Philippe Derakshani
(74) *Attorney, Agent, or Firm*—Sughrue Mion, PLLC

(57) ABSTRACT

A valve gasket for sealing a fluid dispenser device comprising a valve, in particular a metering valve, mounted on a fluid reservoir, said gasket being characterized in that it comprises an alloy of vulcanized ethylene vinyl acetate (EVA) and/or of butyl (IIR) or of vulcanized halobutyl (CIIR or BIIR) with one or more materials selected from the group constituted by polyoctene ethylene (POE), ethylene propylene (EP), ethylene propylene diene monomer (EPDM) and chloroprene rubber (CR), all of these materials being vulcanized.

12 Claims, No Drawings

VALVE GASKET

The present invention relates to a valve gasket for sealing a fluid dispenser device comprising a valve, in particular a metering valve, mounted on a fluid reservoir.

The gaskets used in pressurized fluid dispenser devices, such as aerosol devices, must satisfy certain conditions and meet certain requirements. Thus, such gaskets must offer good mechanical properties, have swelling properties suited to the propellant, offer a suitable coefficient of friction, be propellant-proof, and guarantee good resistance to moisture. In particular, such characteristics are very important for dynamic gaskets forming sealing between the moving valve member of the valve and the valve chamber that contains the metered quantity or "dose" to be discharged.

For various reasons, in particular ecological reasons, propellants of the chlorofluorocarbon (CFC) type have, to a large extent, been replaced by propellants of the hydrofluorocarbon-134a (HFC-134a) or HFC-227 type, with or without alcohol. The use of such propellants modifies the constraints on the gaskets, so that the conventional materials previously used in association with CFC gases no longer have optimum characteristics. In addition, depending on the type of propellant considered (HFC-134a or HFC-227, with or without alcohol), the properties of the gasket materials can vary and can thus be of varying suitability.

Document GB-2 323 597 describes a gasket made of an alloy firstly of a crosslinked, i.e. vulcanized, elastomer material, and secondly of a thermoplastic material and/or a non-crosslinked elastomer thermoplastic material. That type of alloy can be unsuitable for being in contact with propellant of the HFC type.

An object of the present invention is to provide valve gaskets that satisfy the above-mentioned requirements well regardless of the type of the propellant (HFC-134a or HFC-227, with or without alcohol).

Another object of the present invention is to provide a valve gasket that is designed to come into contact with a fluid and with a propellant of the hydrofluoroalkane (HFA) type (HFC-134a or HFC-227) with or without alcohol, and that guarantees mechanical properties and/or swelling properties and/or a coefficient of friction and/or propellant-proofness and/or resistance to moisture that are good.

A further object of the present invention is to provide valve gaskets that are simple and inexpensive to manufacture.

The present invention thus provides a valve gasket for sealing a fluid dispenser device comprising a valve, in particular a metering valve, mounted on a fluid reservoir, said gasket being characterized in that it comprises an alloy of vulcanized ethylene vinyl acetate (EVA) and/or of butyl (IIR) or of vulcanized halobutyl (CIIR or BIIR) with one or more materials selected from the group constituted by polyoctene ethylene (POE), ethylene propylene (EP), ethylene propylene diene monomer (EPDM) and chloroprene rubber (CR), all of these materials being vulcanized.

Advantageously, said gasket comprises ethylene propylene (EP) or ethylene propylene diene monomer (EPDM).

Advantageously, said gasket comprises polyoctene ethylene (POE).

Advantageously, said gasket comprises one or more other ingredients such as inorganic fillers and/or carbon black fillers and/or vulcanization agents and/or dyes and/or processing agents and/or plasticizers.

The present invention also provides a fluid dispenser device comprising a valve, in particular a metering valve, provided with a moving valve member, said valve being mounted on a reservoir containing the fluid and a propellant, the device including at least one neck gasket between the valve and the reservoir, and at least one dynamic gasket in which said valve member slides, at least one of said gaskets being made in accordance with the present invention.

Preferably, the propellant comprises an HFC-134a or HFC-227 gas, with or without alcohol.

In a first variant, the gasket comprises, as a main polymer, essentially a vulcanized ethylene vinyl acetate (EVA) elastomer.

In contact with a propellant of the HFC-134a or HFC-227 type, with or without alcohol (e.g. ethanol), it offers good mechanical properties and low swelling. It is thus particularly well suited for being using as a dynamic gasket. Naturally, it can also be used as a neck gasket in such an aerosol device for providing sealing between the valve and the reservoir containing the fluid and the propellant. It also offers the advantage of alloying easily with other vulcanized elastomer materials, such as polychloroprene (chloroprene rubber or "CR"), polyoctene ethylene (POE), butyl (IIR), halobutyl (CIIR or BIIR), ethylene propylene (EP) or ethylene propylene diene monomer (EPDM). This makes it possible to optimize the properties of the gaskets, in particular as a function of the type of propellant (HFC-134a or HFC-227, with or without alcohol) and/or of the active ingredient to be dispensed.

Adding vulcanized polyoctene guarantees, in particular, low swelling properties when in contact with propellants of the HFC type.

Adding vulcanized ethylene propylene (EP) or vulcanized ethylene propylene diene monomer (EPDM) makes it possible to obtain low swelling for the gaskets, in particular with propellants of the HFC type, while maintaining a good level of mechanical properties, at a reasonable manufacturing cost.

Adding vulcanized polychloroprene (CR) makes it possible to obtain gaskets having good mechanical properties and having low swelling when in propellants of the HFC type.

In a variant, it is also possible to consider implementing gaskets that have, as their main elastomer component, vulcanized butyl (IIR) or halobutyl (CIIR or BIIR). This type of gasket offers good resistance to moisture and low swelling in propellants of the HFC type. Alloys with vulcanized POE and/or EP and/or EPDM and/or CR make it possible to optimize the various properties effectively.

All of the gasket materials described above can be vulcanized and can further include one or more other ingredients, generally well known in the field of gaskets. In particular, the formulation of the gaskets can include inorganic fillers or carbon black fillers, vulcanization agents, dyes, processing agents, or plasticizers.

Valve gaskets of the invention for aerosol dispensers can thus be used in a large number of applications, their formulation depending mainly on the particular mechanical and sealing requirements and on the fluids and propellants to be put in contact with said gaskets.

Ease of manufacture and low cost are also advantageous aspects of the gaskets of the present invention.

The invention claimed is:

1. A valve gasket for sealing a fluid dispenser device comprising a valve, in particular a metering valve, mounted on a fluid reservoir, said gasket being characterized in that it comprises an alloy of vulcanized ethylene vinyl acetate (EVA) and/or of butyl (IIR) or of vulcanized halobutyl (CIIR or BIIR) with one or more materials selected from the group constituted by polyoctene ethylene (POE), ethylene propylene (EP), ethylene propylene diene monomer (EPDM) and chloroprene rubber (CR), all of these materials being vulcanized.

2. A gasket according to claim 1, in which said gasket comprises ethylene propylene (EP) or ethylene proplene diene monomer (EPDM).

3. A gasket according to claim 1, in which said gasket comprises polyoctene ethylene (POE).

4. A gasket according to claim 1, in which said gasket comprises one or more other ingredients such as inorganic fillers and/or carbon black fillers and/or vulcanization agents and/or dyes and/or processing agents and/or plasticizers.

5. A fluid dispenser device comprising a valve, in particular a metering valve, provided with a moving valve member, said valve being mounted on a reservoir containing the fluid and a propellant, the device including at least one neck gasket between the valve and the reservoir, and at least one dynamic gasket in which said valve member slides, said dispenser device being characterized in that at least one of said gaskets is made in accordance with claim 1.

6. A fluid dispenser according to claim 5, in which the propellant comprises an HFC-134a or HFC-227 gas, with or without alcohol.

7. A dispenser comprising valve gasket for sealing a fluid dispenser device, the gasket comprising an alloy of vulcanized ethylene vinyl acetate (EVA) or of butyl (IIR) or of vulcanized halobutyl (CIIR or BIIR) with one or more of the following vulcanized materials: polyoctene ethylene (POE), ethylene propylene (EP), ethylene propylene diene monomer (EPDM) and chloroprene rubber (CR).

8. The dispenser according to claim 7, further comprising a metering valve mounted on a fluid reservoir.

9. The dispenser according to claim 7, wherein the gasket comprises vulcanized ethylene vinyl acetate (EVA).

10. The dispenser according to claim 7, wherein the gasket comprises vulcanized halobutyl (CIIR or BIIR).

11. The dispenser according to claim 7, wherein the gasket comprises ethylene propylene (EP) or ethylene proplene diene monomer (EPDM).

12. The dispenser according to claim 7, wherein the gasket comprises polyoctene ethylene (POE).

* * * * *